US009833650B2

(12) United States Patent
Jones

(10) Patent No.: US 9,833,650 B2
(45) Date of Patent: Dec. 5, 2017

(54) EXERCISE DEVICE

(71) Applicant: Dylan Jones, Columbus, OH (US)

(72) Inventor: Dylan Jones, Columbus, OH (US)

(73) Assignee: COULTER VENTURES LLC, Columbus, OH (US)

( * ) Notice: Subject to any disclaimer, the term of this patent is extended or adjusted under 35 U.S.C. 154(b) by 25 days.

(21) Appl. No.: 14/276,464

(22) Filed: May 13, 2014

(65) Prior Publication Data

US 2014/0342885 A1 Nov. 20, 2014

Related U.S. Application Data

(60) Provisional application No. 61/823,117, filed on May 14, 2013.

(51) Int. Cl.

| | |
|---|---|
| ***A63B 21/00*** | (2006.01) |
| ***A63B 21/04*** | (2006.01) |
| ***A61H 1/00*** | (2006.01) |
| ***A61H 1/02*** | (2006.01) |
| ***A61H 15/00*** | (2006.01) |
| ***A63B 22/18*** | (2006.01) |

(Continued)

(52) U.S. Cl.

CPC .... *A63B 21/00185* (2013.01); *A63B 21/0004* (2013.01); *A63B 22/0046* (2013.01); *A63B 22/18* (2013.01); *A63B 45/00* (2013.01); *A63B 26/003* (2013.01); *A63B 43/00* (2013.01); *A63B 2023/006* (2013.01)

(58) Field of Classification Search

CPC . A63B 21/0004; A63B 22/0046; A63B 22/18; A63B 26/003; A63B 2023/006; A63B 41/08; A63B 41/085; A63B 43/00; A63B 45/00; A63B 43/002; A63B 43/04; A63B 37/0001; A63B 37/0058; A63B 37/04; A63B 37/12; A63B 37/14; A61H 1/008; A61H 2201/1284; A61H 2201/1623; A61H 2201/1695; A61H 2201/1685; A61H 2201/0161; A61H 2201/0167; A61H 2201/0107; A61H 2201/01; A61H 15/00; A61H 15/0092; A61H 2015/0007; A61H 2015/0014; A61H 2015/0021; A61H 2015/0042; A61H 2015/005; A61H 2015/0057; A61H 2015/0064; A61H 2015/0071; A61H 2205/081; A61H 2203/0456; A61H 7/001; A63F 2009/124; G09B 27/08

USPC ..... 482/132

See application file for complete search history.

(56) References Cited

U.S. PATENT DOCUMENTS 2,086,094 A * 7/1937 Reach ..... A63B 37/14 473/613

2,495,079 A * 1/1950 Sonnett ..... A63B 41/08 473/597

(Continued)

OTHER PUBLICATIONS

EP Application No. 14 168 249.2 Search Report dated Sep. 22, 2014.

*Primary Examiner* — Joshua Lee

(74) *Attorney, Agent, or Firm* — Vorys, Sater, Seymour and Pease LLP; William L. Klima

(57) ABSTRACT

A exercise ball device can include a ball and one or more panels supported by the ball. The ball can be substantially rigid and the at least one panel can be soft or resiliently deformable. The exercise ball can include a belt for guiding and positioning the one or more panels on the ball.

29 Claims, 14 Drawing Sheets

(51) Int. Cl.

| | |
|---|---|
| ***A63B 22/00*** | (2006.01) |
| ***A63B 45/00*** | (2006.01) |
| *A63B 43/00* | (2006.01) |
| *A63B 23/00* | (2006.01) |
| *A63B 26/00* | (2006.01) |

(56) References Cited

U.S. PATENT DOCUMENTS 2,684,106 A * 7/1954 Fegan ..... 156/213
3,618,955 A * 11/1971 Barnes ..... A63F 9/12 264/152
3,863,923 A * 2/1975 Anderson ..... A63B 39/06 40/327
4,050,184 A * 9/1977 Chiari ..... A63H 33/101 273/157 R
4,934,698 A * 6/1990 Lary ..... A63B 37/06 473/125
5,080,591 A * 1/1992 Forsyth ..... G09B 27/08 434/147
5,096,193 A * 3/1992 Lee ..... A63B 37/0001 273/DIG. 20
5,389,063 A * 2/1995 Wu ..... A61H 7/001 273/153 S
5,441,261 A * 8/1995 Margolis ..... A63F 9/12 273/157 R
5,577,995 A * 11/1996 Walker ..... A61H 15/0092 601/118
5,676,550 A * 10/1997 Giamportone ..... G09B 27/08 434/130
5,833,548 A * 11/1998 Ellis ..... A63B 37/0001 273/DIG. 20
5,931,677 A * 8/1999 Rifat ..... G09B 5/062 273/237
5,931,752 A * 8/1999 Guenther ..... A63B 41/08 473/597
6,231,460 B1 * 5/2001 Higuchi ..... A63B 37/0003 473/351
6,302,815 B1 * 10/2001 Shishido ..... A63B 41/08 473/598
6,464,502 B1 * 10/2002 Munekata ..... G09B 27/08 434/130
6,520,877 B1 * 2/2003 Yang ..... A63B 41/08 473/597
6,805,350 B1 * 10/2004 Wu ..... A63B 43/00 273/156
7,267,624 B2 * 9/2007 Tapper ..... A63B 37/0004 473/383
7,517,324 B2 * 4/2009 Cohen ..... A61H 7/001 601/135
7,740,551 B2 * 6/2010 Nurnberg ..... A63B 41/02 473/570
7,854,671 B2 * 12/2010 Lalvani ..... A63B 41/08 473/598
D738,963 S * 9/2015 Bogen ..... D21/478
2002/0025866 A1 * 2/2002 Thomas ..... A63B 37/14 473/598
2002/0098927 A1 7/2002 Ou
2003/0045383 A1 * 3/2003 Jiminez ..... A63B 41/08 473/597
2003/0157999 A1 * 8/2003 Yu ..... A63B 37/0023 473/371
2003/0226300 A1 * 12/2003 Ootsuka ..... A47G 1/12 40/622
2004/0142779 A1 * 7/2004 Chan ..... A63B 37/12 473/600
2005/0079936 A1 * 4/2005 Litchfield ..... A63B 37/12 473/596
2005/0266943 A1 * 12/2005 Lin ..... A63B 37/12 473/598
2006/0089578 A1 * 4/2006 Hsu ..... A61H 15/00 601/118
2006/0255538 A1 * 11/2006 Chen ..... A63F 9/001 273/156
2007/0010360 A1 * 1/2007 Chang ..... A63B 37/12 473/598
2007/0037642 A1 * 2/2007 Chang ..... A63B 41/08 473/604
2007/0225133 A1 * 9/2007 Castro ..... A63B 21/0004 482/140
2007/0275787 A1 * 11/2007 Bouchard ..... A63B 37/0001 473/125
2008/0189891 A1 * 8/2008 McLain ..... A47L 11/08 15/209.1
2009/0325747 A1 * 12/2009 Ou ..... A63B 41/08 473/605
2010/0301558 A1 * 12/2010 Speegle ..... A63F 9/12 273/153 S
2011/0256967 A1 * 10/2011 Shore ..... A63H 33/18 473/595
2011/0272882 A1 * 11/2011 Yahyavi ..... A63F 9/0861 273/153 S
2012/0001388 A1 * 1/2012 Wu ..... A63F 9/12 273/157 R
2012/0329587 A1 * 12/2012 Ou ..... A63B 41/08 473/605
2013/0059683 A1 * 3/2013 Krysiak ..... A63B 41/08 473/597
2013/0139797 A1 * 6/2013 Oblack ..... F41B 3/04 124/5
2014/0274465 A1 * 9/2014 Francis ..... A63B 43/00 473/351

* cited by examiner

EXERCISE DEVICE

RELATED APPLICATION(S)

This application is a Non-Provisional Application, which claims benefit under 35 U.S.C. 119(e) of U.S. Provisional Application No. 61/823,117, filed on May 14, 2013, the content of which is hereby incorporated by reference in its entirety.

FIELD

An exercise device, in particular an exercise ball device comprising or consisting of a ball, a guide (e.g. belt or ribbon) connected to the ball, and a plurality of panels connected to the ball and guided or aligned into position by the guide, the guide and panels providing an exterior surface of the exercise ball device.

BACKGROUND

In the past, various types of balls are used as exercise balls. The exercise balls are typically deformable and filled with air. A person can exercise using the exercise ball in many different ways to exercise.

SUMMARY

An improved exercise ball device.

A composite exercise ball device.

An exercise ball device comprising or consisting of a ball and one or more panels connected to the ball.

An exercise ball device comprising or consisting of a ball, a panel positioning or guiding or aligning belt or ribbon connected to the ball, and a plurality of panels connected to the ball with the edges of the panels matching the edges of the panel positioning belt.

An exercise ball device comprising or consisting of a ball, a guide connected to the ball, and a plurality of panels connected to the ball and positioned on the ball by the guide, the guide and panels fitting together like a puzzle to provide an outer surface of the exercise ball device.

An exercise ball device comprising or consisting of a ball supporting multiple different size and shaped panels.

An exercise ball device comprising or consisting of a ball supporting a wave-shaped panel positioning belt or guide, and multiple panels connected to the ball and aligned by the panel positioning belt.

An exercise ball device comprising or consisting of a ball supporting a three dimensional panel positioning guide, and multiple panels connected to the ball and positioned on the ball by the guide.

A method of making an exercise ball comprising or consisting of providing a ball, belt, and one or more panels, applying the belt onto the ball; and applying one or more panels onto the ball, wherein the belt guides and positions the panels when applying the panels onto the exercise ball device.

A method of making an exercise ball comprising or consisting of providing a ball, belt, and one or more panels, applying the belt onto the ball; and applying one or more panels onto the ball using the belt to guide or position the panels onto the ball.

A method of making an exercise ball comprising or consisting of providing a ball, belt, and one or more panels, applying the belt onto the ball; and applying one or more panels onto the ball with edges of the panels abutting edges of the belt, wherein the belt and one or more panels provide an outer surface of the exercise ball device.

A method of making an exercise ball comprising or consisting of providing a ball, belt, and one or more panels, adhering the belt onto the ball; and adhering one or more panels onto the ball, the belt and one or more panels providing an outer surface of the exercise ball device.

A method of making an exercise ball comprising or consisting of providing a substantially rigid ball, applying a belt to a surface of the ball to define multiple unique-shaped regions on the surface of the ball, and fitting multiple unique-shaped panels into the multiple unique-shaped regions on the surface of the ball edge-to-edge with the belt.

The exercise device can be an exercise ball device comprising or consisting of a ball and at least one panel. For example, the exercise ball device comprises or consists of a ball and multiple panels connected to the ball. The panels can be of the same size and shape, or can be of different size and/or shape. Alternatively, the shape of the exercise device can be spherical (i.e. ball shaped), or can be other shapes (e.g. pyramid, cube, cylindrical, rectangular, octahedron, torus, etc.).

In the exercise ball device, the ball can be a rigid or substantially rigid ball. For example, the ball is made of plastic, hard plastic, nylon, polyethylene, polypropylene, polyurethane, acrylonitrile butadiene styrene (ABS), polycarbonate, acrylic, composite material, fiberglass, carbon fiber, boron fiber, Kevlar. For example, the ball is a formed article (e.g. molded, injection molded, extruded). Alternatively, the ball can be machined from a plastic pre-form or block of plastic material.

The exercise ball device can comprise or consist of a ball and at least one panel supported by the ball. For example, the panel can be made separately and then applied to the ball (e.g. by adhering, taping, gluing, and/or mechanically coupling). Alternatively, the at least one panel can be formed on the ball (e.g. overmolded onto or around ball, for example, by insert molding).

The panel or panels can each be made as a single piece, or can be made of multiple pieces joined together (e.g. molded, adhered, taped, glued, mechanically coupled, or combination thereof). For example, the panels can each be made with a inner support panel (e.g. made of molded nylon) and an outer cover panel made of resilient soft or deformable material (e.g. thermoplastic elastomer). The panel or panels can be smooth or textured (e.g. grooved, bumps, raised pattern, projections, spikes). For example, the panel or panels can be molded from thermoplastic elastomer (TPE) material.

The exercise ball device can comprise a ball, panel or panels, and a panel positioning guide (e.g. belt or ribbon). The belt, for example, can be ornamental (e.g. provided with a particular design and/or logo) and/or can be functional, for example, to act as a guide, positioning, or alignment device used when applying the panel or panels to the ball. The belt can be a single piece construction, or a multiple piece construction.

The belt can have a particular shape (e.g. wave-shaped). The belt, for example, can be a molded article (e.g. plastic injection molded). The belt can comprise or consist of a single belt, a plurality of separated belt portions, or a plurality of interconnected belt portions.

The belt can be configured to defined unique-shaped regions on the surface of the ball when the belt is applied (e.g. adhered) to the surface of the ball. The panels can be unique-shaped to match with the unique-shaped regions on the surface defined by the belt. For example, a particular panel can only fit into a particular region on the surface of the ball like a three dimension puzzle. Alternatively, there can exist repeating panel shapes matching repeating region shapes on the surface of the ball.

The belt and panels can fit together edge-to-edge on the surface of the ball. Further, the thickness of the belt and panels can be the same (i.e. flush fit edge-to-edge), or can be of a different thickness (e.g. panels thicker or thinner compared to thickness of belt).

DETAILED DESCRIPTION

Figure 1:
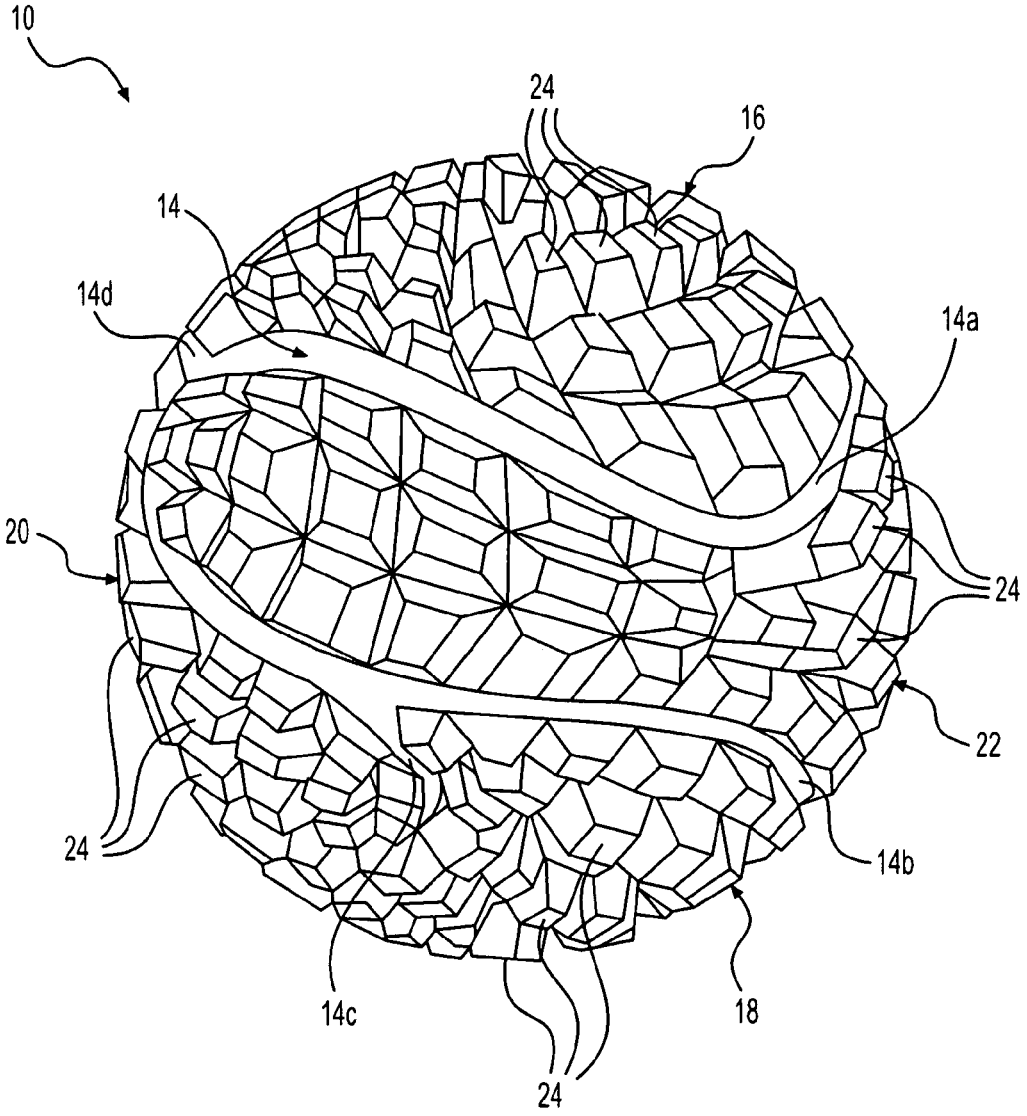
FIG. 1 is a perspective view of an assembled exercise ball device.
Figure 2:
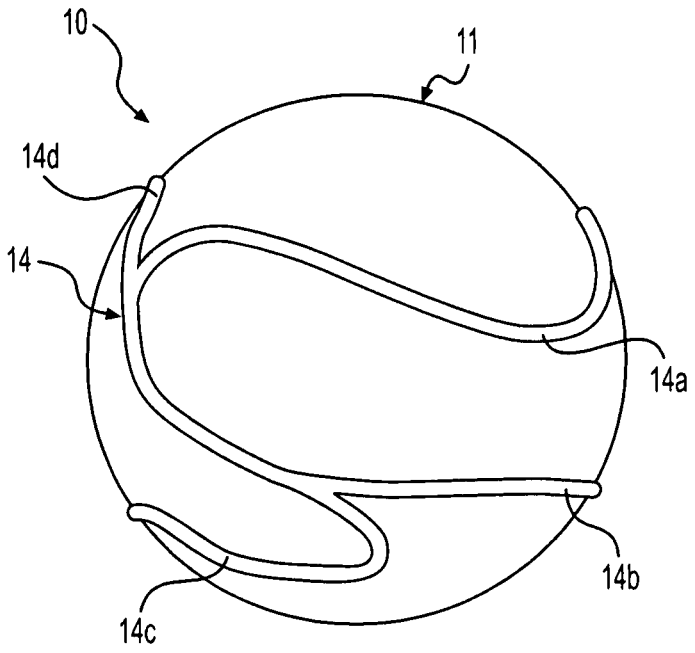
FIG. 2 is a front elevational view of the exercise ball device shown in FIG. 1 with the panels removed showing the configuration of the belt.
Figure 3:
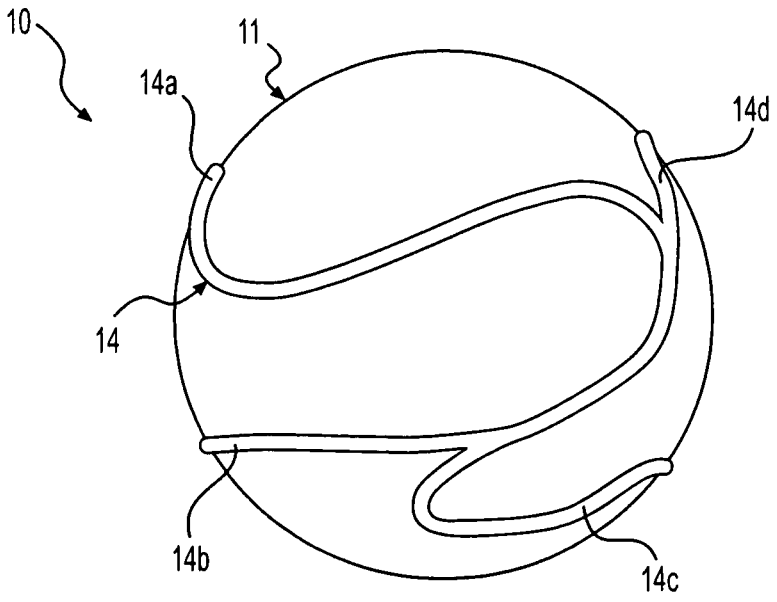
FIG. 3 is a rear elevational view of the exercise ball device shown in FIG. 1 with the panels removed showing the configuration of the belt.
Figure 4:
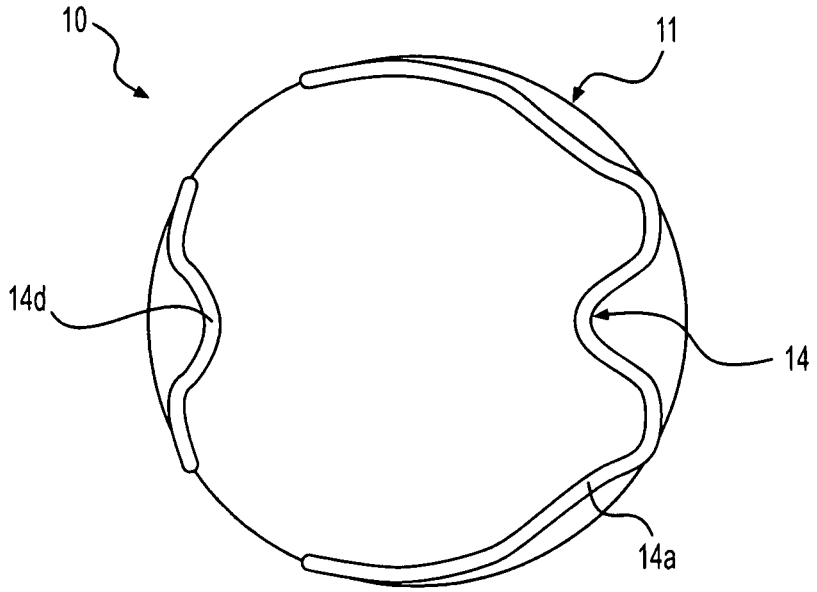
FIG. 4 is a top planar view of the exercise ball device shown in FIG. 1 with the panels removed showing the configuration of the belt.
Figure 5:
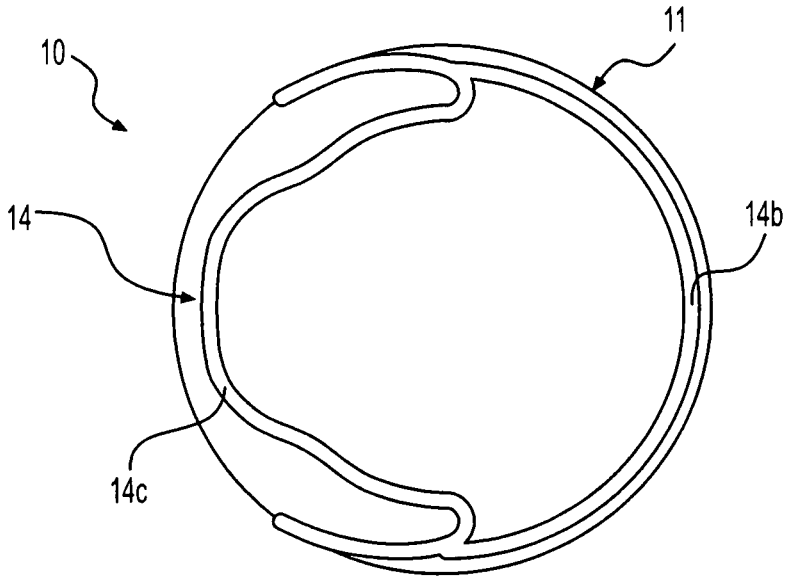
FIG. 5 is a bottom planar view of the exercise ball device shown in FIG. 1 with the panels removed showing the configuration of the belt.
Figure 6:
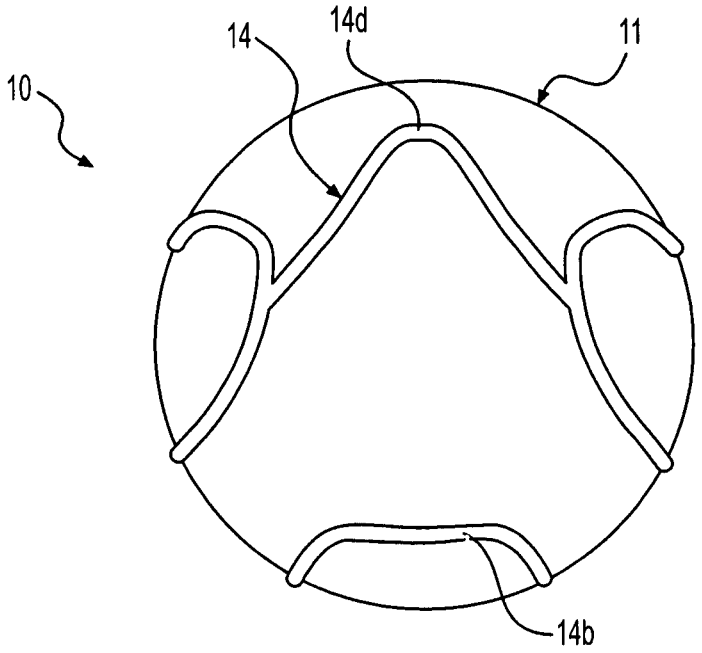
FIG. 6 is a left side elevational view of the exercise ball device shown in FIG. 1 with the panels removed showing the configuration of the belt.
Figure 7:
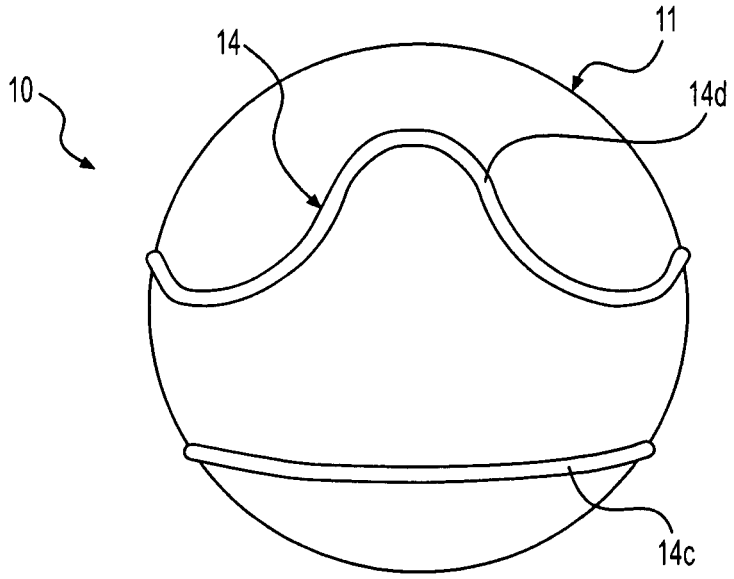
FIG. 7 is a right side elevational view of the exercise ball device shown in FIG. 1 with the panels removed showing the configuration of the belt.

An exercise ball device 10 is shown in FIGS. 1 thru 7. The exercise ball device 10 comprises or consists of a ball 12 (FIG. 2), a belt 14, and four (4) panels 16, 18, 20, 22. The ball 11 is rigid or substantially rigid. For example, the ball 11 can be an injection molded article made of nylon material.

The belt 14 can be a separate part or component made prior to being applied to the ball 11. For example, the belt 14 is a plastic injection molded article, which is then bonded or adhered to an outer surface of the ball 11. The thickness of the belt 14 can be less, the same, or more than the thickness of the panels 16, 18, 20, 22. Alternatively, the belt 14 can be overmolded onto the ball 11.

The belt 14 comprises wave-shaped portions connected together (i.e. interconnected) with loop shaped portions, and is continuous (i.e. no belt ends). Further, belt members 14*a*, 14*b*, 14*c* (FIGS. 2 and 7) can connect together at one or more belt nodes. Alternatively, the belt 14 can be a plurality of separate belt or belt portions (e.g. disconnected belt portions, connected belt portions, or other shapes and sizes).

The belt 14 once applied to the outer surface of the ball 11 serves as a positioning or alignment guide for application of the panels 16, 18, 20, 22 onto the outer surface of the ball 11, for example, by using adhesive material. The belt 14 defines unique-shaped regions on the surface of the ball 11 matching the unique-shaped panels 16, 18, 20, 22. The belt 14 and panels 16, 18, 20, 22 fit together like a three-dimensional puzzle on the outer surface of the ball 11, and provide a composite outer ball surface or surface layer. The panels 16, 18, 20, and 22 are shown abutting the belt 14; however, the panels 16 can be made with edges that partially or completely overlap the belt 14. As a further alternative, the panels 16, 18, 20, and 22 can be overmolded onto the ball 11 supporting the belt 14 (e.g. no layer or thin layer overmolded onto the belt 14 with the panels overmolded on portions of the exposed ball 11).

The panels 16, 18, 20, 22 are of a different size and shape, and are unique-shaped (i.e. each panel 16, 18, 20, and 22 are different shaped). The panels 16, 18, 20, 22 are textured by each being provided with a pattern of protrusions or spikes 24. For example, the spikes can be 4 mm or less to facilitate demolding of the panels when being injection molded. The size and shape of the edges of the panels 16, 18, 20, 22 match the size and shape of portions of the belt 14 so that the components or parts fit together like a three dimensional puzzle when applied to the outer ball surface of the ball 11.

The panels 16, 18, 20, 22 comprise base portions (e.g. layer or layers) supporting the spikes 24. The thickness of the base portions can be the same or similar to the thickness of the belt 12 (e.g. flush fit). The spikes 24 extend upwardly from the base portions resulting in an outer surface elevated above the height of the belt 14 (i.e. the belt appears recessed into the surface of the ball due to the spikes 24). Thus, usually the spikes 24 only come into contact with the user or floor, and the belt does not usually make contact therewith.

Method of Making

Figure 8:
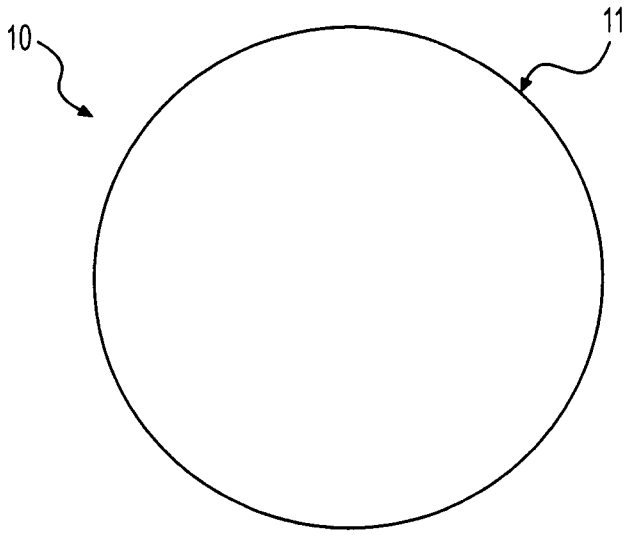
FIG. 8 is a front elevational view of the exercise ball device shown in FIG. 1 with the belt and panels removed showing the configuration of the ball.
Figure 9:
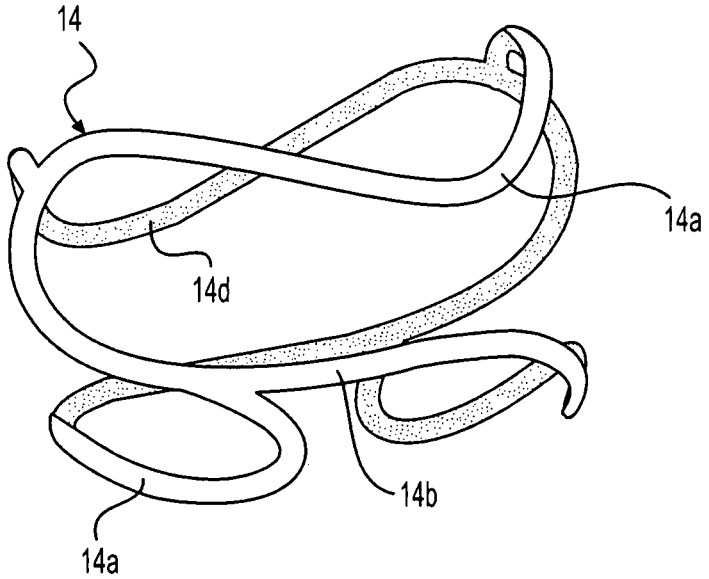
FIG. 9 is a perspective view of the belt only removed from the exercise ball device shown in FIG. 1.
Figure 10:
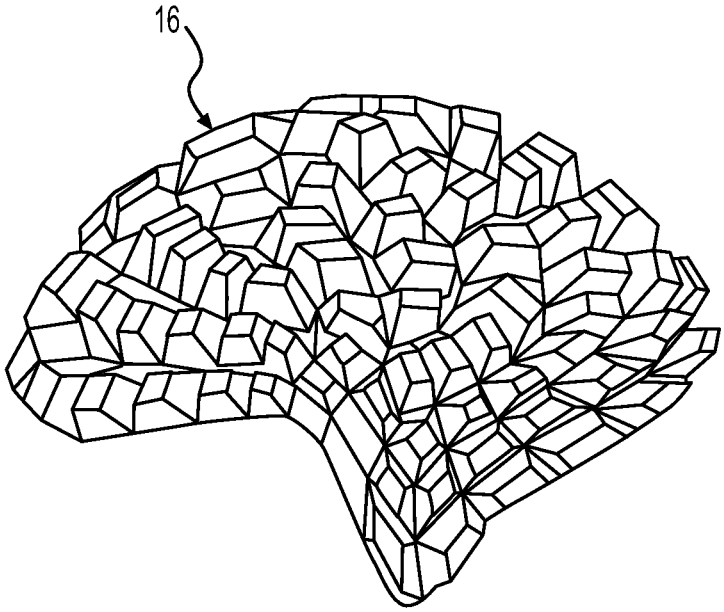
FIG. 10 is a perspective view of the top panel of the exercise ball device shown in FIG. 1.
Figure 11:
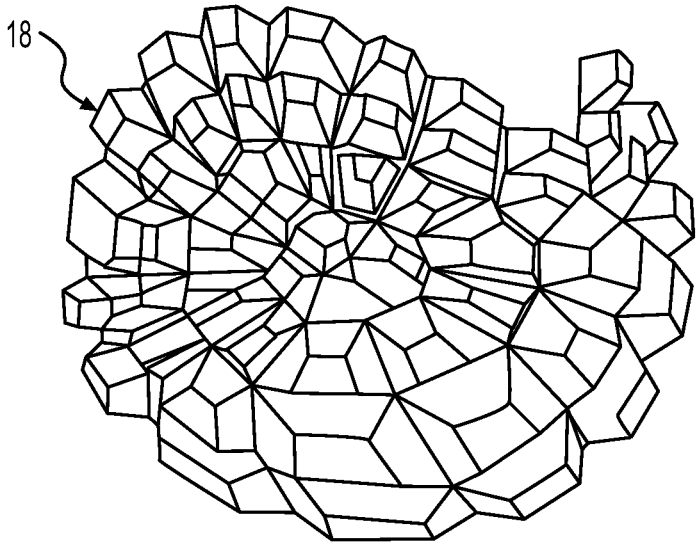
FIG. 11 is a perspective view of the bottom panel of the exercise ball device shown in FIG. 1.
Figure 12:
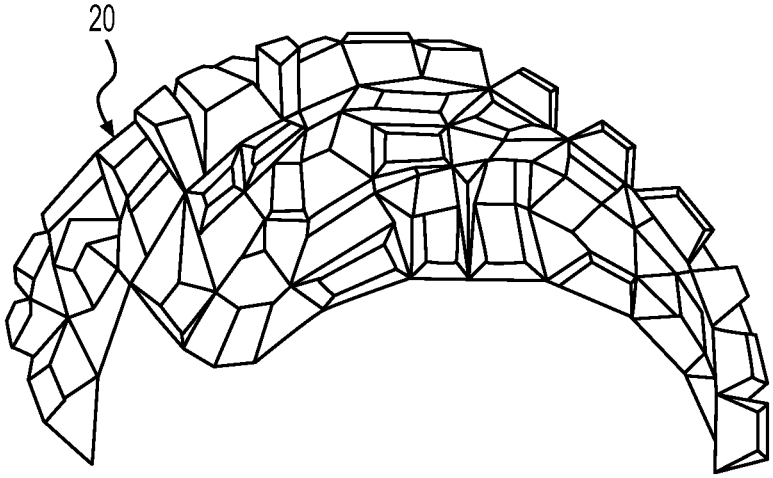
FIG. 12 is a perspective view of the lower side panel of the exercise ball device shown in FIG. 1.
Figure 13:
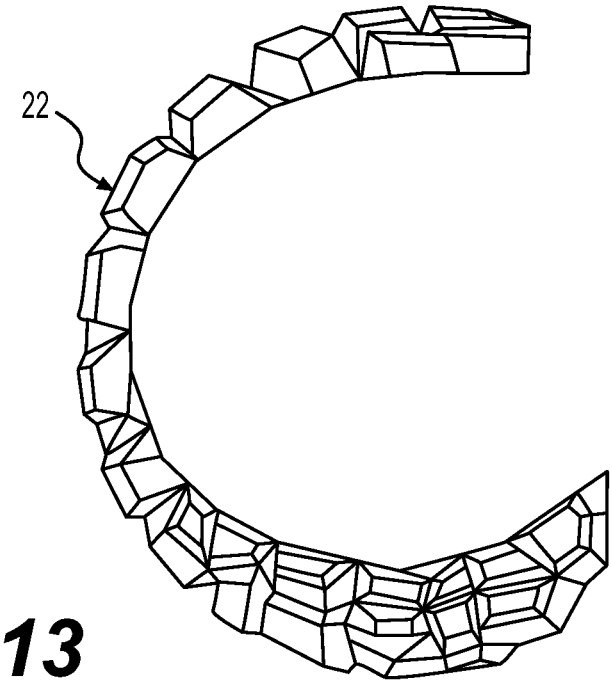
FIG. 13 is a perspective view of the middle panel of the exercise ball device shown in FIG. 1.

The exercise ball device 10 can be made by first making the ball 11 (FIG. 8) by forming, extruding, machining, molding, injection molding. The ball 11 can be made of plastic, plastic material, metal, composite, fiberglass, carbon fiber, Kevlar.

Figure 14:
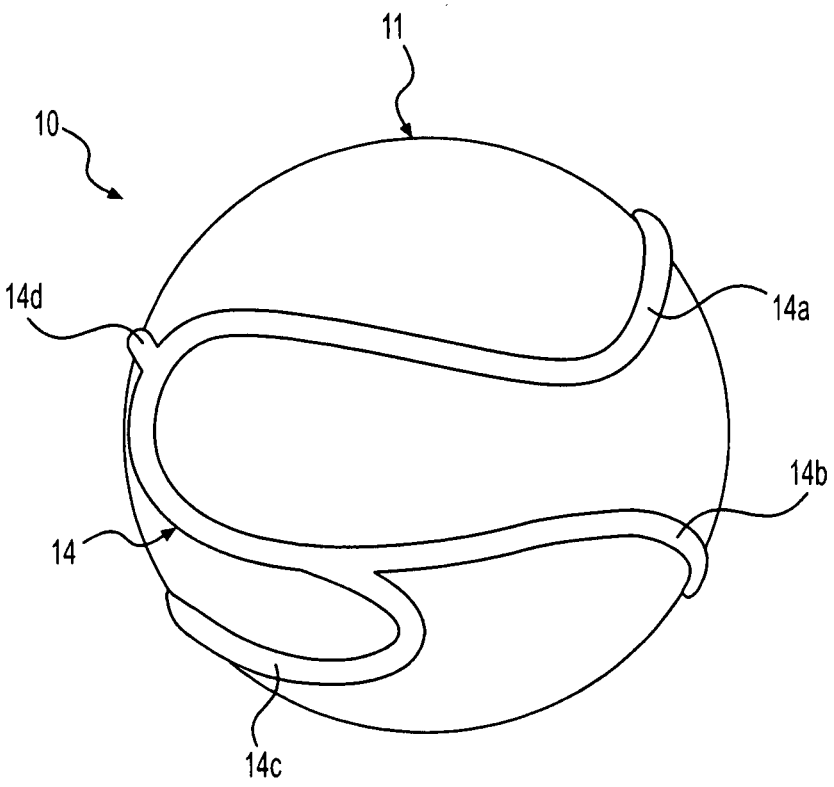
FIG. 14 is a front elevational view of the exercise ball device shown in FIG. 1 being constructed by providing the belt on the ball.
Figure 15:
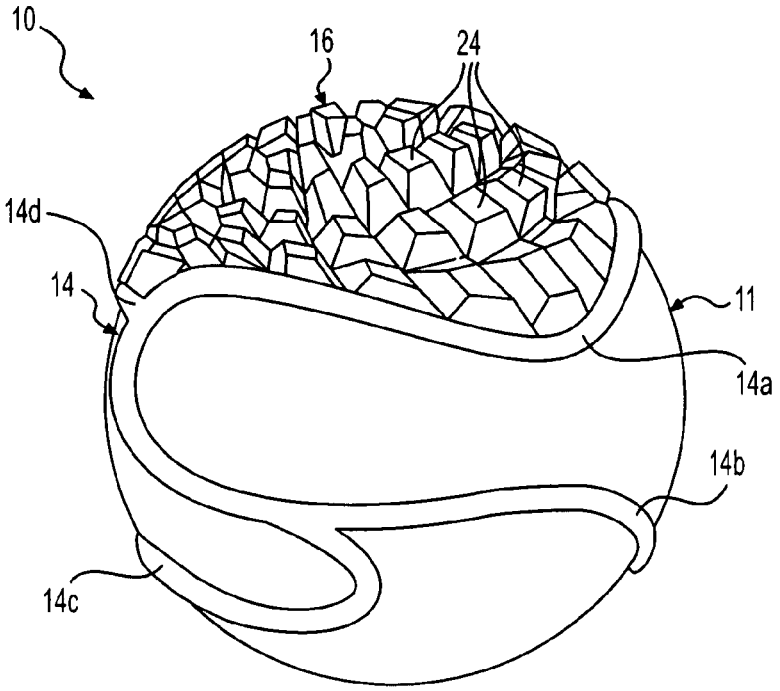
FIG. 15 is a front elevational view of the exercise ball device shown in FIG. 1 being constructed by providing the belt and the top panel on the ball.
Figure 16:
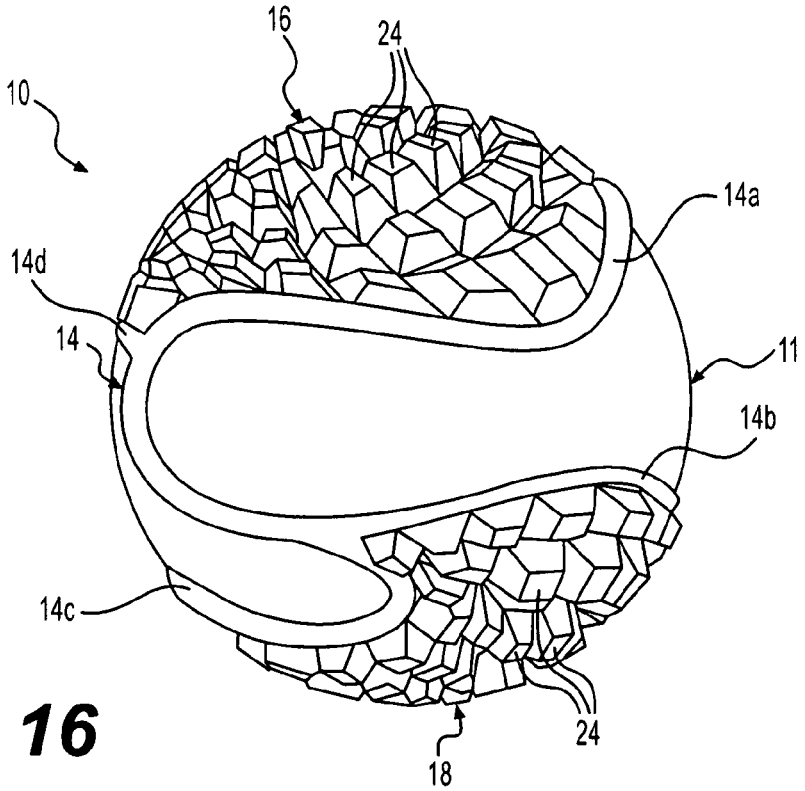
FIG. 16 is a front elevational view of the exercise ball device shown in FIG. 1 being constructed by providing the belt, top panel, and bottom panel on the ball.
Figure 17:
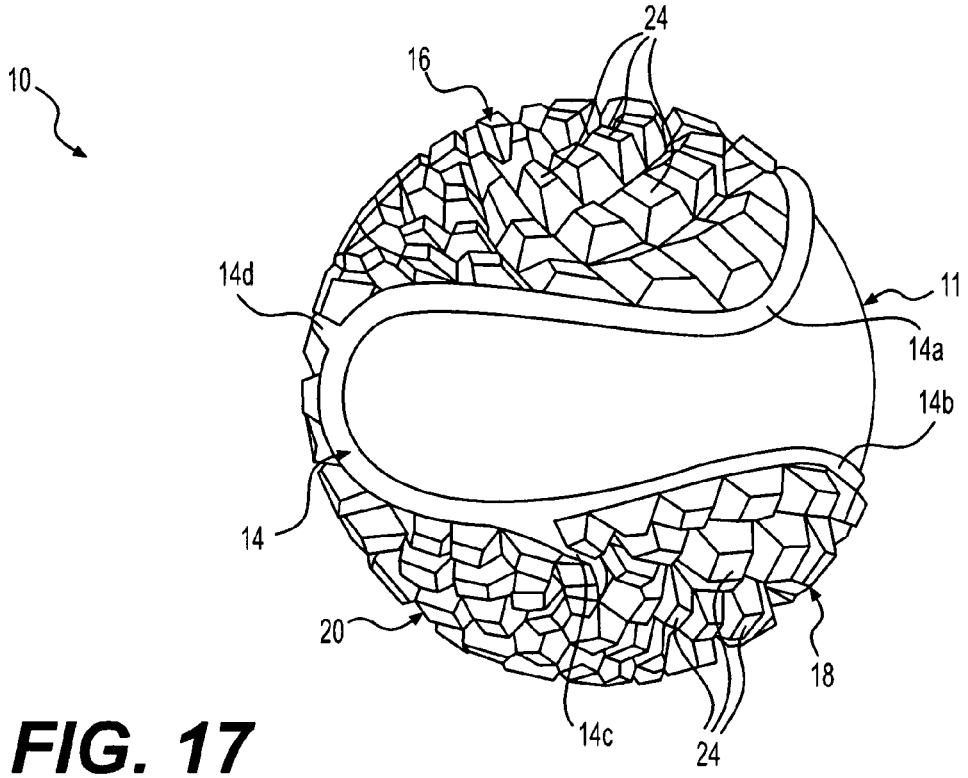
FIG. 17 is a front elevational view of the exercise ball device shown in FIG. 1 being constructed by providing the belt, top panel, bottom panel, and bottom side panel on the ball.
Figure 18:
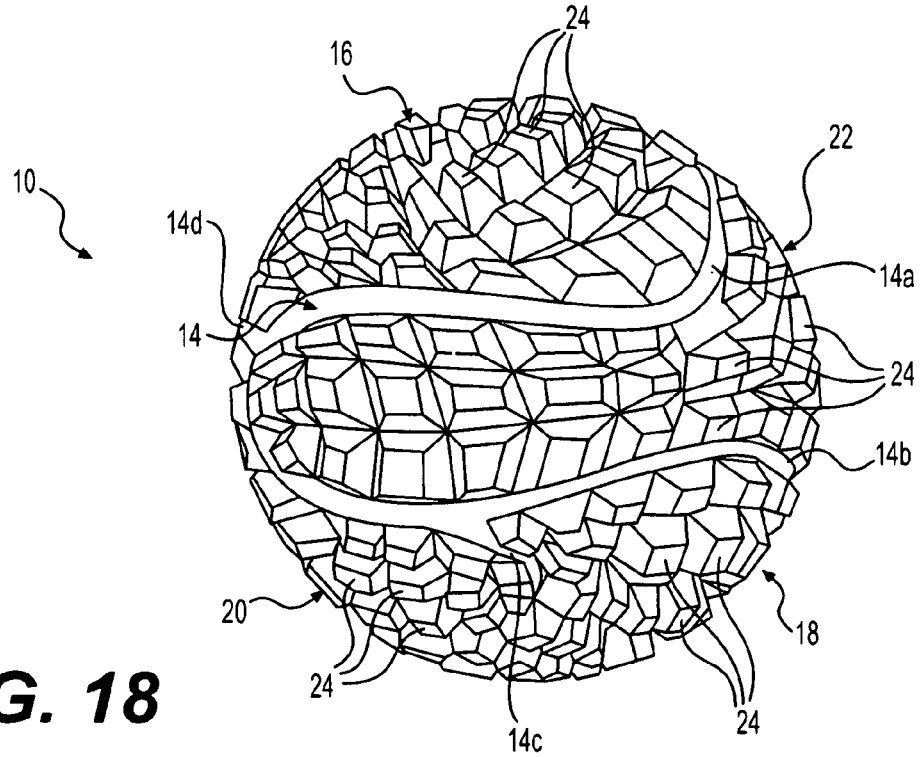
FIG. 18 is a front elevational view of the exercise ball device shown in FIG. 1 being constructed by providing the belt, top panel, bottom panel, bottom side panel, and middle panel on the ball.
Figure 19:
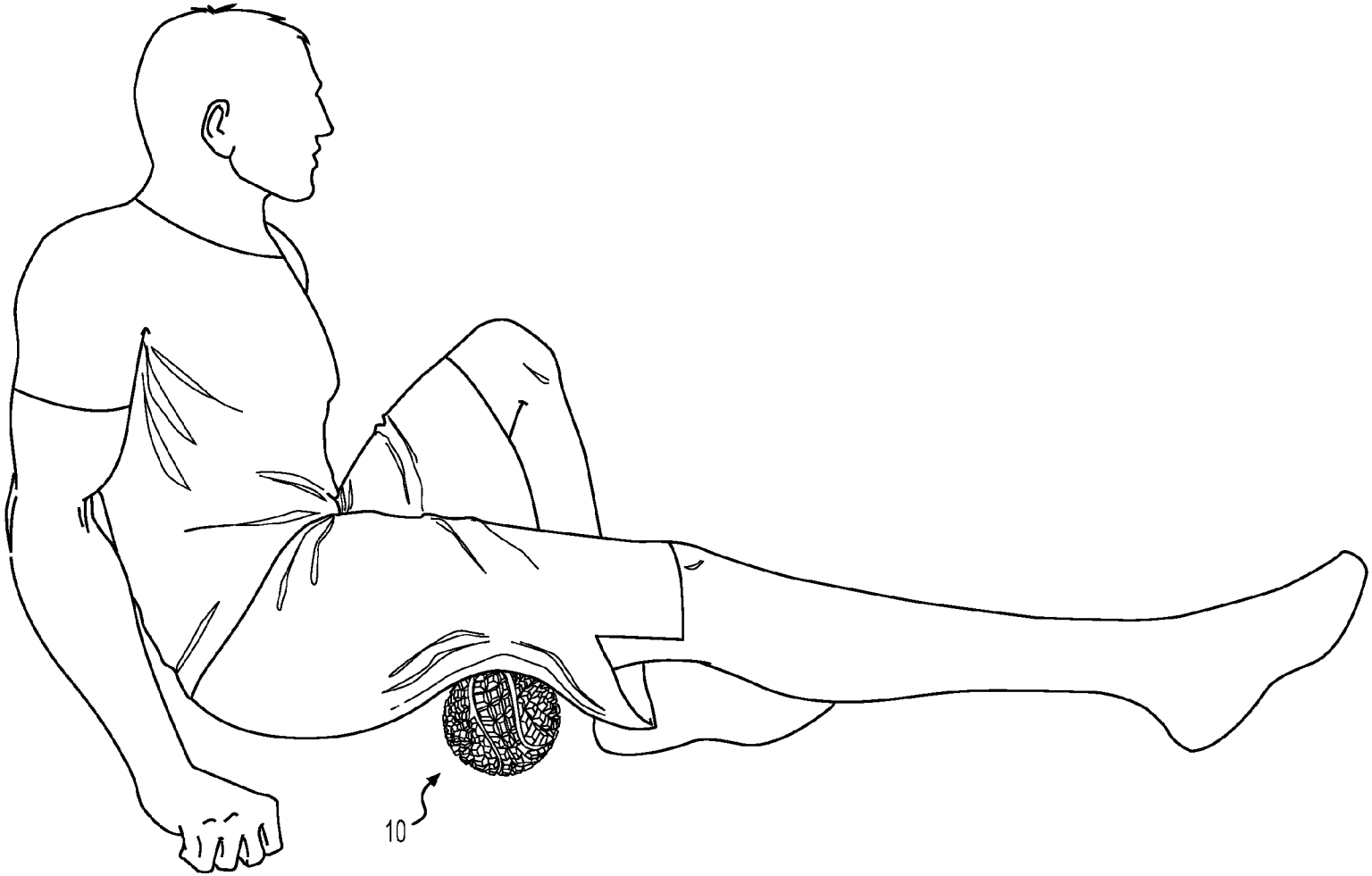
FIG. 19 is a diagrammatic view of the user with the exercise ball device shown in FIG. 1 under the right thigh of the user.
Figure 20:
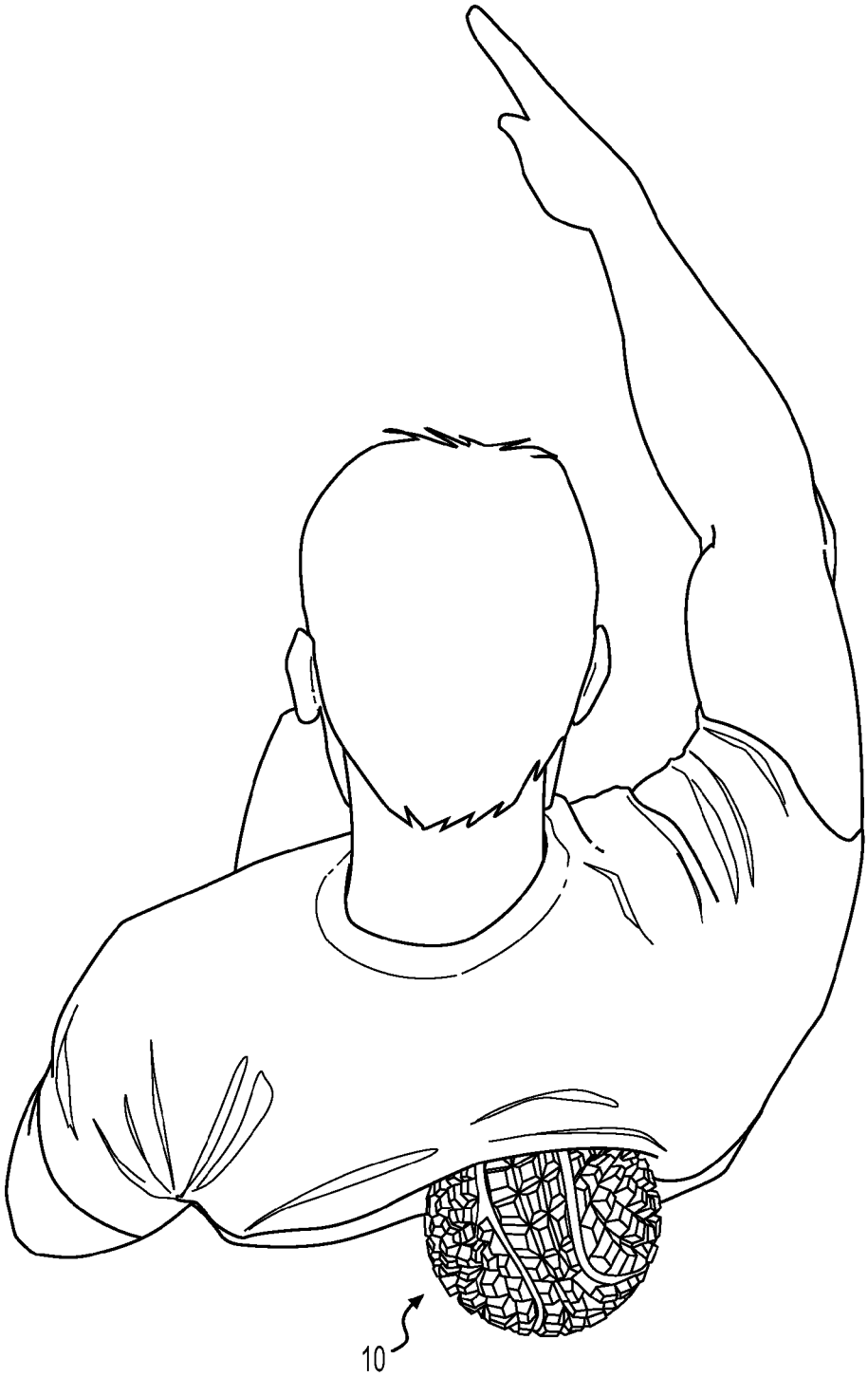
FIG. 20 is a diagrammatic view of the user with the exercise ball device shown in FIG. 1 under the back of the user.
Figure 21:
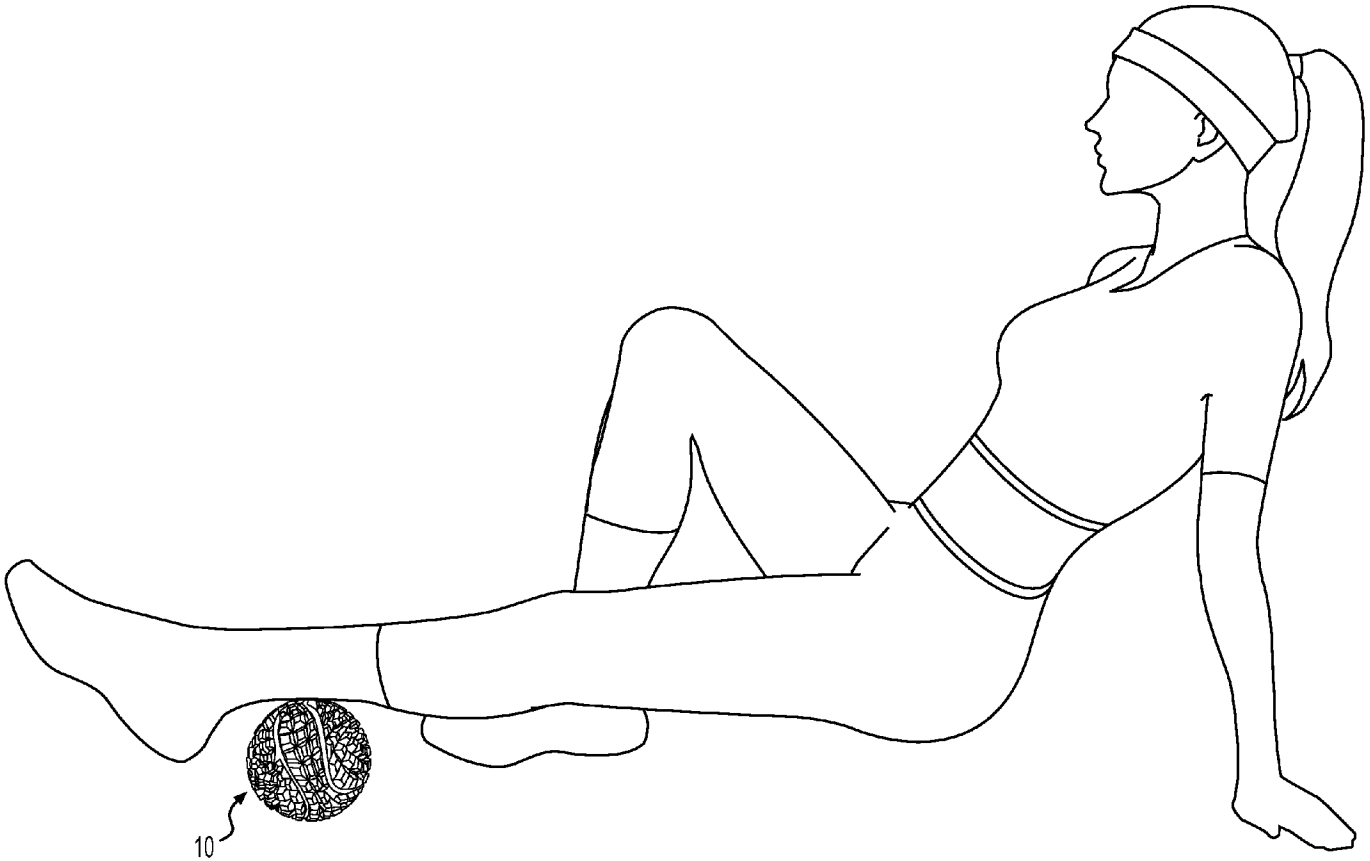
FIG. 21 is a diagrammatic view of a user with the exercise ball device shown in FIG. 1 under the left ankle of the user.
Figure 22:
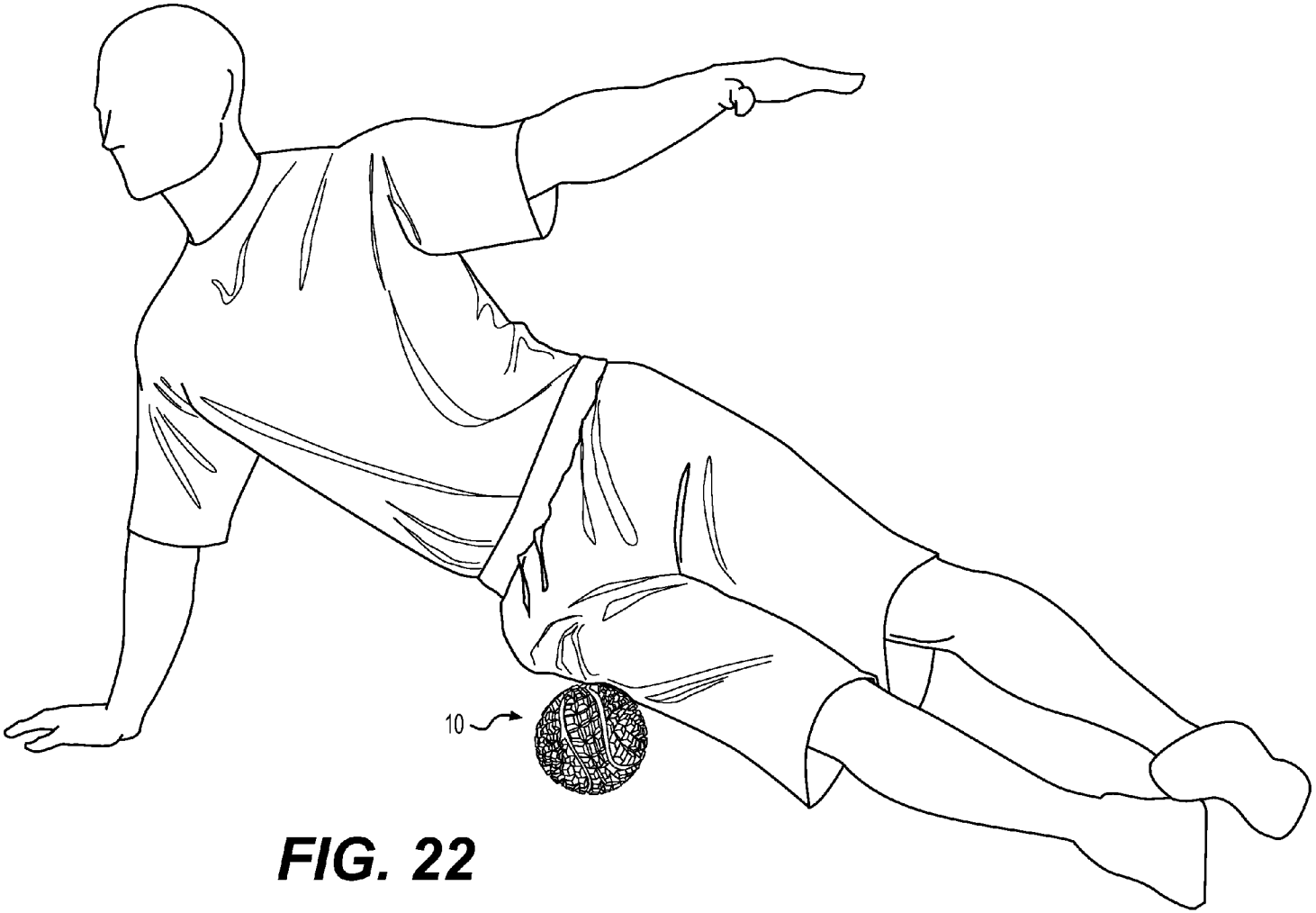
FIG. 22 is a diagrammatic view of the user with the exercise ball device shown in FIG. 1 under the side of the right thigh of the user.

The belt 14 is then adhered to the outer surface of the ball 11 using adhesive material or tape, as shown in FIG. 14.

The panels 18, 20, 22, 24 are then applied to the outer surface of the ball 11 using adhesive material or tape, as shown in FIGS. 15 thru 18. Specifically, the panels 18, 20, 22, 23 are fitted and guided into their particular positions dictated by the configuration and location of the belt 14 on the ball 11 like a three dimensional puzzle to complete assembly of the exercise ball device 10.

The belt 14 can be plastic injection molded. The belt can be designed to that the mold can be split in 2-directions fairly cleanly (i.e. into two halves). Some undercut can be provided.

The ball 11, for example, can be a 3.8 inch molded nylon ball. The panels should wrap less than 25-34% around the ball to allow demolding. The belt 14 can be overmolded onto the ball 11.

I claim:

1. An exercise ball device configured for physical exercise use, the exercise ball device comprising:

a hard rigid ball;

a belt connected to the ball and located on an outer surface of the ball; and one or more panels connected to the ball and located on the outer surface of the ball, the one or more panels comprising one or more edges abutting one or more edges of the belt, wherein the one or more panels comprise an inner support panel and an outer cover panel, wherein the inner support panel is made of rigid plastic material and the outer cover panel is made of resilient or deformable material, wherein the belt and the one or more panels define an outer surface of the exercise ball device, wherein the belt and the one or more panels are securely connected to the ball in a manner to prevent disconnection from the ball; and wherein the exercise ball device is configured to withstand the physical exercise use.

2. The device according to claim 1, wherein the exercise device is a sphere-shaped exercise device.

3. The device according to claim 1, wherein the belt is configured to guide or align the one or more panels.

4. The device according to claim 1, wherein the one or more panels are multiple panels.

5. The device according to claim 4, wherein two or more of the multiple panels are of different size and shape.

6. The device according to claim 4, wherein the belt and the multiple panels fit together edge-to-edge on the outer surface of the ball.

7. The device according to claim 1, wherein an edge shape of the belt matches an edge shape of the one or more panels.

8. The device according to claim 1, wherein the one or more panels are multiple panels, and an edge shape of the belt matches an edge shape of the multiple panels when the exercise ball device is assembled.

9. The device according to claim 8, wherein the belt defines unique shaped regions on an outer surface of the ball, and each panel fits a particular region on the outer surface of the ball.

10. The device according to claim 1, wherein a thickness of the belt is less than a thickness of the one or more panels.

11. The device according to claim 1, wherein a thickness of the belt is the same as a thickness of the one or more panels.

12. The device according to claim 1, wherein a thickness of the belt is more than a thickness of the one or more panels.

13. The device according to claim 1, wherein the belt comprises multiple belt elements connected together at one or more belt nodes.

14. The device according to claim 13, wherein the belt comprises multiple narrow belt elements connected together at multiple belt nodes configured to envelope the ball within the belt.

15. The device according to claim 1, wherein the hard rigid ball is made of rigid plastic material.

16. The device according to claim 15, wherein the plastic material is one selected from the group consisting of nylon, polyethylene, polypropylene, polyurethane, acrylonitrile butadiene styrene, polycarbonate, acrylic, fiberglass, carbon fiber, boron fiber, and composite material.

17. The device according to claim 1, wherein the rigid ball is a solid rigid ball.

18. The device according to claim 1, wherein the belt and one or more panels are adhered to the outer surface of the ball.

19. The device according to claim 1, wherein the belt and one or more panels are overmolded onto the outer surface of the ball.

20. The device according to claim 1, wherein the belt and one or more panels are injection molded and adhered onto the outer surface of the ball.

21. The device according to claim 1, wherein each outer cover panel is overmolded onto each respective inner support panel.

22. The device according to claim 1, wherein the belt and the one or more panels are connected to the ball using an adhesive suitable to prevent disconnection from the ball during the physical exercise use.

23. The device according to claim 1, wherein the belt and one or more panels are overmolded onto the outer surface of the ball in a manner to prevent removal from the ball during the physical exercise use.

24. The device according to claim 1, wherein the belt is a continuous belt.

25. The device according to claim 1, wherein the belt comprises one or more narrow belt elements having a width less than the width of the one or more panels.

26. The device according to claim 1, wherein the belt is a plastic injection molded belt.

27. A method of making an exercise ball comprising:

providing a hard rigid ball;

applying a belt to a surface of the ball to define multiple unique-shaped regions on the surface of the ball; and fitting multiple unique-shaped panels into the multiple unique-shaped regions on the surface of the ball edge-to-edge with the belt, wherein the panels comprise an inner support panel and an outer cover panel, wherein the inner support panel is made of rigid plastic material and the outer cover panel is made of resilient or deformable material.

28. An exercise ball device, comprising:

a hard rigid ball;

a preformed belt adhered to an outer surface of the ball; and one or more preformed panels adhered to the outer surface of the ball adjacent to the performed belt, the one or more performed panels comprising one or more edges abutting one or more edges of the performed belt, wherein the one or more preformed panels comprise an inner support panel and an outer cover panel, wherein the inner support panel is made of rigid plastic material and the outer cover panel is made of resilient or deformable material, wherein the performed belt and the one or more performed panels define an outer surface of the exercise ball device.

29. An exercise ball device, comprising:

a rigid ball;

a belt connected to the ball and located on an outer surface of the ball; and one or more panels connected to the ball and located on the outer surface of the ball, the one or more panels comprising one or more edges abutting one or more edges of the belt, and the belt and the one or more panels providing an outer surface of the exercise ball device, wherein the one or more panels comprise an inner support panel and an outer cover panel, and wherein the inner support panel is made of rigid plastic material and the outer cover panel is made of resilient or deformable material.

* * * * *